US007397298B2

(12) United States Patent
Tsukude

(10) Patent No.: US 7,397,298 B2
(45) Date of Patent: Jul. 8, 2008

(54) SEMICONDUCTOR DEVICE HAVING INTERNAL POWER SUPPLY VOLTAGE GENERATION CIRCUIT

(75) Inventor: Masaki Tsukude, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 76 days.

(21) Appl. No.: 11/493,673

(22) Filed: Jul. 27, 2006

(65) Prior Publication Data

US 2007/0024349 A1 Feb. 1, 2007

(30) Foreign Application Priority Data

Jul. 27, 2005 (JP) ..... 2005-217794

(51) Int. Cl.
*G05F 1/10* (2006.01)

(52) U.S. Cl. ..... 327/535; 327/536

(58) Field of Classification Search ..... 327/534–537
See application file for complete search history.

(56) References Cited

U.S. PATENT DOCUMENTS 6,069,518 A * 5/2000 Nakai et al. ..... 327/535
6,191,994 B1 * 2/2001 Ooishi ..... 365/226
6,282,108 B1 * 8/2001 Yang ..... 363/60
6,510,394 B2 * 1/2003 Huang et al. ..... 702/65
6,771,115 B2 8/2004 Nakano

FOREIGN PATENT DOCUMENTS

JP 2004-63019 2/2004
JP 2004-280923 10/2004

* cited by examiner

*Primary Examiner*—Dinh T. Le
(74) *Attorney, Agent, or Firm*—McDermott Will & Emery LLP

(57) ABSTRACT

The composing circuit outputs a lower voltage out of voltages output from the constant voltage generation circuit and the dummy pump circuit as a voltage to the sensing circuit. The sensing circuit compares voltages to generate a pump activation signal for activating the pump circuit. Since when an external power supply voltage is a low voltage, the voltage applied to the sensing circuit will be an output voltage of the dummy pump circuit having the same output characteristics as those of the pump circuit in place of the reference voltage, no pump activation signal is generated. As a result, when the external power supply voltage is a low voltage, power consumption can be suppressed without uselessly outputting a pump activation signal.

5 Claims, 6 Drawing Sheets

SEMICONDUCTOR DEVICE HAVING INTERNAL POWER SUPPLY VOLTAGE GENERATION CIRCUIT

BACKGROUND OF THE INVENTION

1. Field of the Invention

The present invention relates to a semiconductor device and, more particularly, a semiconductor device having an internal power supply voltage generation circuit.

2. Description of the Background Art

Some of semiconductor devices are provided with various kinds of internal power supply voltage generation circuits for generating a voltage level different from an external power supply voltage applied to an internal circuit from the outside of the semiconductor device by using the external power supply voltage. In recent years, while demanded is a circuit structure with an operation voltage lowered in order to reduce power consumption, because a required operation voltage level varies according to the purpose of use, also demanded is provision of an internal power supply voltage generation circuit which generates a higher voltage level as compared with an external power supply voltage, for example, a booster circuit.

Circuit structure of a booster circuit includes, for example, a constant voltage generation circuit for outputting a reference voltage whose level is fixed independently of an external power supply voltage, a pump circuit for generating a boosted voltage level, a shifter for shifting a boosted voltage level by a certain rate, and a sensing circuit for comparing an output of the shifter and an output of the constant voltage generation circuit to control pumping operation so as to maintain a boosted voltage level at a desired value based on the comparison result.

In addition, Japanese Patent Laying-Open No. 2004-63019 discloses a booster circuit which reduces power consumption at the time of stand-by of an internal power supply voltage generation circuit in a semiconductor storage device. Japanese Patent Laying-Open No. 2004-280923 discloses a booster circuit with suppressed effects of temperature dependency and threshold voltage dependency of an internal power supply voltage generation circuit.

In these circuits, however, when an external power supply voltage is at a level not more than a target voltage level, as a boosted voltage level, because it is increased with an increase in the voltage level of the external power supply voltage, only a voltage level extremely lower than the maximum output level of the pump circuit can be output. In other words, when the external power supply voltage is a low voltage, the maximum output level of the pump circuit and an output level of the constant voltage generation circuit might be close to each other or inverted.

While the sensing circuit continues outputting an activation signal to instruct on pumping operation when determining that a boosted voltage level is low, when the external power supply voltage is a low voltage, because the pump circuit has no output which obtains such a level as inactivates an activation signal of the sensing circuit, it will be instructed to execute pumping operation all the time.

As a result, characteristics that power consumption of the pump circuit is increased will be obtained.

Although in particular, when the voltage level of the external power supply voltage is high as an operation voltage guaranteed by the device, this increase of power consumption is not a great problem, the lower the voltage level of the external power supply voltage becomes, the greater the effect on the device exerted by the increase in power consumption will be to pose a problem.

SUMMARY OF THE INVENTION

An object of the present invention, which aims at solving the above-described problem, is to provide a semiconductor device having an internal power supply voltage generation circuit which enables suppression of power consumption even when an external power supply voltage is at a level equal to or less than a target voltage level.

The semiconductor device according to the present invention includes a first pump circuit which generates an internal power supply voltage by pumping operation upon reception of an external power supply voltage externally supplied, an internal circuit which receives supply of the internal power supply voltage from the first pump circuit, a reference voltage generation circuit which generates a first reference voltage, a second pump circuit which generates a second reference voltage by pumping operation upon reception of supply of the external power supply voltage and whose operation current at the time of pumping operation is less than an operation current of the first pump circuit, and an activation signal generation unit which compares a voltage based on the internal power supply voltage with the first reference voltage or the second reference voltage to generate an activation signal for controlling pumping operation of the first pump circuit based on the comparison result.

The semiconductor device according to the present invention is provided with an activation signal generation unit which compares the first reference voltage or the second reference voltage with a voltage based on the internal power supply voltage to control pumping operation of the first pump circuit based on the comparison result, and a second pump circuit which generates the second reference voltage.

When the external power supply voltage is low, the second reference voltage of the second pump circuit is lower than the first reference voltage and is the same as the voltage based on the internal power supply voltage, so that no activation signal will be generated. In other words, when the external power supply voltage is low, no activation signal that controls pumping operation of the first pump circuit will be generated, so that an increase in power consumption involved in the generation of an unnecessary activation signal which has been a conventional problem can be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
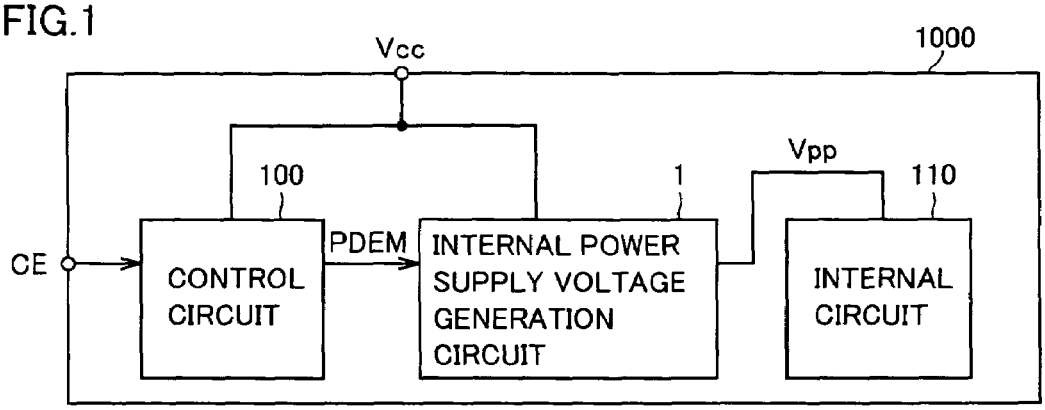
FIG. 1 is a schematic block diagram for use in explaining a semiconductor device according to an embodiment of the present invention.

In the following, the embodiment of the present invention will be described in detail with reference to the drawings. The same reference numerals in the drawings will denote the same or corresponding parts.

With reference to FIG. 1, a semiconductor device 1000 according to the embodiment of the present invention includes a control circuit 100 for controlling the entire semiconductor device, internal power supply voltage generation circuit 1 and an internal circuit 110.

Internal power supply voltage generation circuit 1 is activated in response to a control signal PDEN output from control circuit 100 to generate an internal power supply voltage Vpp upon reception of supply of an external power supply voltage VCC from the outside. Internal circuit 110 operates based on internal power supply voltage Vpp generated by internal power supply voltage generation circuit 1. Control circuit 100 operates upon reception of supply of external power supply voltage VCC, as well as giving a predetermined instruction to the circuit in the semiconductor device in response to an external instruction. In the present example, it is assumed that a chip enable signal CE as an external instruction is applied to control circuit 100, and control circuit 100, in response to the input of chip enable signal CE, outputs control signal PDEN which activates internal power supply voltage generation circuit 1.

In the present example, description will be made mainly of the internal power supply voltage generation circuit which generates a boosted voltage as an example. In a case, for example, where a DRAM memory, a flash memory or the like is built in as a memory in semiconductor device 1000 although not shown in the drawing, a word line driver circuit which drives a word line of the memory corresponds to the internal circuit. Alternatively, a well voltage circuit for supplying a well voltage corresponds to the internal circuit.

Figure 2:
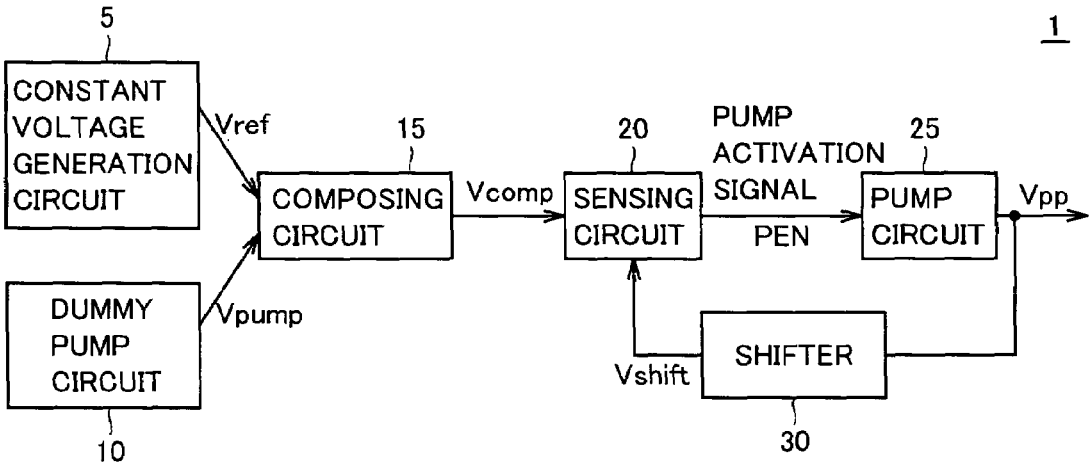
FIG. 2 is a schematic block diagram of an internal power supply voltage generation circuit 1 according to the embodiment of the present invention.

With reference to FIG. 2, internal power supply voltage generation circuit 1 according to the embodiment of the present invention includes a constant voltage generation circuit 5, dummy pump circuit 10, a composing circuit 15 which receives a reference voltage Vref and a voltage Vpump output from constant voltage generation circuit 5 and dummy pump circuit 10, respectively, to output a lower one of the voltages, sensing circuit 20 which receives a voltage Vcomp output from the composing circuit to output a pump activation signal PEN based on comparison with a voltage Vshift, pump circuit 25 which is activated upon reception of input of pump activation signal PEN from sensing circuit 20 to execute pumping operation and shifter 30 which steps down (shift) output voltage Vpp from pump circuit 25 to output the obtained voltage as voltage Vshift. Composing circuit 15, sensing circuit 20 and shifter 30 form an activation signal generation unit which outputs pump activation signal PEN.

Figure 3:
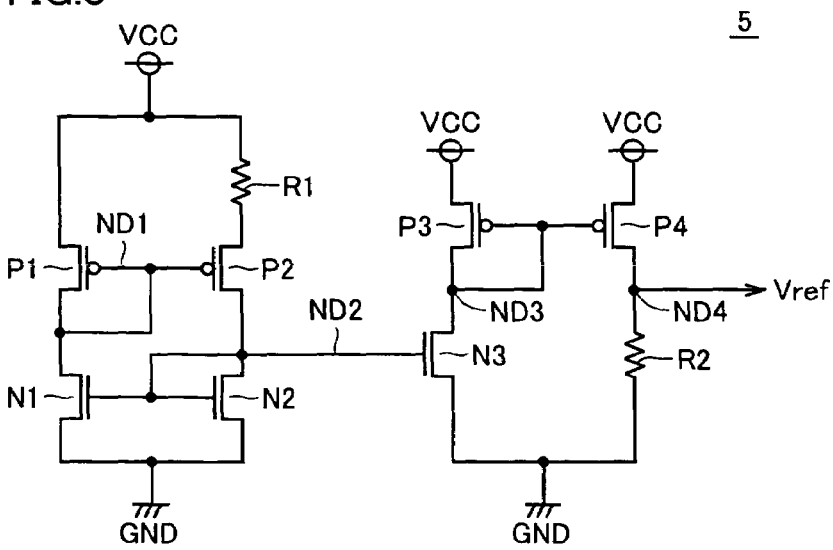
FIG. 3 is a diagram showing a circuit structure of a constant voltage generation circuit according to the embodiment of the present invention.

With reference to FIG. 3, constant voltage generation circuit 5 according to the embodiment of the present invention includes transistors P1 to P4 and N1 to N3 and resistors R1 and R2.

Here, transistors P1 to P4 are assumed to be P channel MOS transistors. Transistors N1 to N3 are assumed to be N channel MOS transistors. In the following, they will be simply referred to as transistors.

Specific connection relationship will be described.

Transistor P1 is arranged between power supply voltage VCC and a node ND1 and has its gate electrically connected to node ND1. Transistor N1 is arranged between node ND1 and a fixed voltage GND and has its gate electrically connected to an internal node ND2. Transistor P2 is arranged between power supply voltage VCC and internal node ND2 with resistor R1 provided therebetween so as to form a current mirror circuit with transistor P1 and has its gate electrically connected to internal node ND1. Transistor N2 is arranged between internal node ND2 and fixed voltage GND so as to form a current mirror circuit with transistor N1 and has its gate electrically connected to internal node ND2.

Transistor P3 is arranged between power supply voltage VCC and an internal node ND3 and has its gate electrically connected to internal node ND3. Transistor P4 is arranged between power supply voltage VCC and an output node ND4 so as to form a current mirror circuit with transistor P3 and has its gate electrically connected to internal node ND3. Transistor N3 is arranged between internal node ND3 and fixed voltage GND and has its gate electrically connected to internal node ND2. Resistor R2 is arranged between output node ND4 and fixed voltage GND.

Operation of constant voltage generation circuit 5 according to the embodiment of the present invention will be described.

As described above, transistors P1 and P2 form a current mirror circuit. In addition, because transistors N1 and N2 form a current mirror circuit, the same current as the current flowing through transistors P1 and N1 intends to flow through transistors P2 and N2. Since resistor R1 is here structured to be arranged between transistors P2 and N2 and power supply voltage VCC and fixed voltage GND, adjustment of a resistance value of resistor R1 enables the amount of current to be adjusted.

Accordingly, with this circuit, a fixed constant voltage is generated for internal node ND2. Then, the voltage will be applied as a gate voltage to transistor N3.

In addition, transistors P3 and P4 form a current mirror circuit. Accordingly, a current flowing through transistors P3 and N3 will be mirrored by a voltage level of the gate voltage of transistor N3 to flow into transistor P4.

Since resistor R2 is here structured to be arranged between output node ND4 and fixed voltage GND, adjustment of a resistance value of resistor R2 enables a voltage level of output node ND4 to be adjusted.

In other words, reference voltage Vref as a fixed constant voltage is generated at output node ND4 of constant voltage generation circuit 5 according to the embodiment of the present invention based on the resistance values of resistors R1 and R2.

Figure 4:
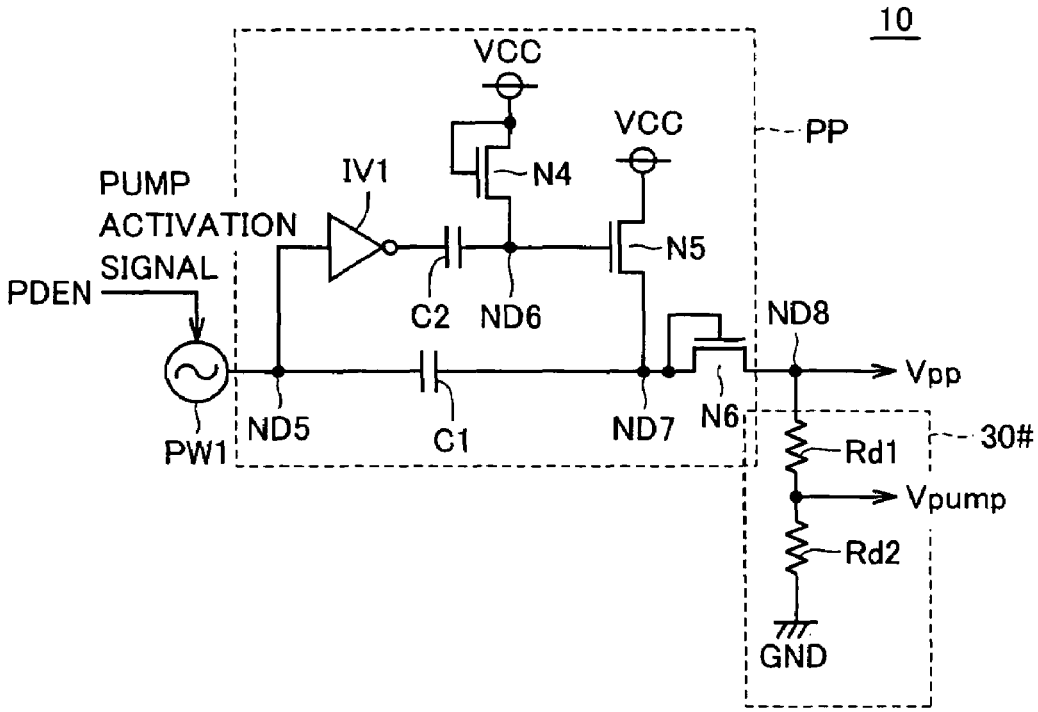
FIG. 4 is a diagram showing a circuit structure of a dummy pump circuit 10 according to the embodiment of the present invention.

With reference to FIG. 4, dummy pump circuit 10 according to the embodiment of the present invention includes pump driving signal generation circuit PW1, a pump circuit PP and a shifter 30#. Pump driving signal generation circuit PW1 is activated upon reception of input of pump activation signal PDEN to output a clock signal of a fixed cycle as a pump driving signal to an internal node ND5.

Pump circuit PP includes an inverter IV1, capacitors C1 and C2 and transistors N4 to N6. Transistors N4 to N6 are assumed to be N channel MOS transistors.

Specific connection relationship will be described.

Inverter IV1 and capacitor C2 are connected in series between internal node ND5 and an internal node ND6. Capacitor C1 is arranged between internal node ND5 and a internal node ND7. Transistor N4 is arranged between power supply voltage VCC and internal node ND6 and has its gate electrically connected to power supply voltage VCC. Transistor N5 is arranged between power supply voltage VCC and internal node ND7 and has its gate electrically connected to internal node ND6. Transistor N6 is arranged between an internal node ND8 and internal node ND7 and has its gate electrically connected to internal node ND7.

When, for example, pump driving signal generation circuit PW1 is activated by the application of pump activation signal PDEN to transmit the pump driving signal to internal node ND5, the potential level of internal node ND5 rises from a ground voltage GND level to a power supply voltage VCC level. Capacitor C2 is charged to the power supply voltage VCC level according to the voltage level of internal node ND5 and transmitted to internal node ND6. Because transistor N4 is a diode-connected transistor, the voltage level of internal node ND6 is set to be power supply voltage VCC−Vth with a drop of threshold voltage Vth. As a result, the gate potential of transistor N5, that is, the voltage level of internal node ND6 attains 2VCC−Vth due to capacitive coupling of capacitor C2. Consequently, when the potential level of internal node ND7 attains VCC and then the voltage level of internal node ND5 changes from the ground voltage GND level to the power supply voltage VCC level, the voltage level of internal node ND7 is set to a 2VCC level from the VCC level due to the principle of conservation of charge. Then, because transistor N6 is diode-connected, the voltage level of output node ND8 is set to be 2VCC−Vth with a drop of threshold voltage Vth of transistor N6. In other words, boosted voltage Vpp has its maximum output level set to be 2VCC−Vth. In a case, for example, where external power supply voltage VCC is 1.8V and threshold voltage Vth is 0.5 to 1.0V, the maximum output level 2VCC−Vth will be set to be 2.6 to 3.1V.

Shifter 30# generates voltage Vpump by reducing boosted voltage Vpp which is generated at internal node ND8 by a predetermined reduction rate according to a resistance division of resistors Rd1 and Rd2.

Figure 5:
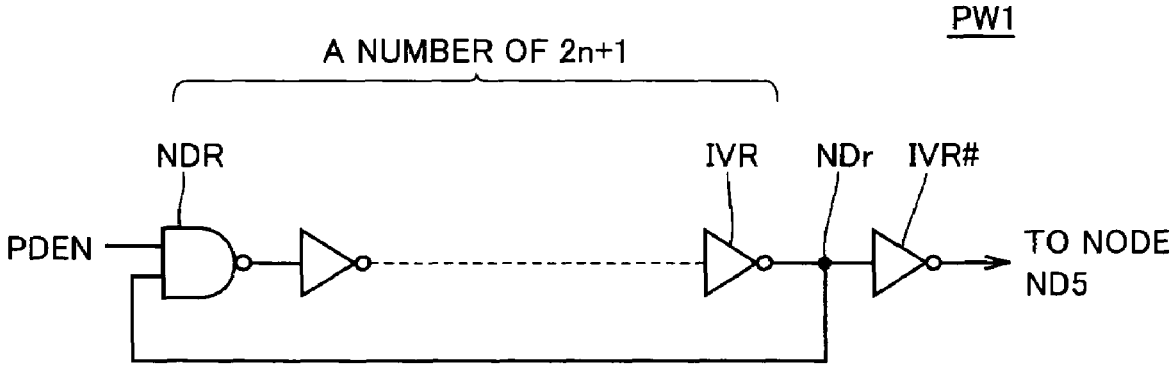
FIG. 5 is a diagram showing a circuit structure of a pump driving signal generation circuit PW1.

With reference to FIG. 5, pump driving signal generation circuit PW1 according to the embodiment of the present invention is so-called a ring oscillator and formed of a plurality of inverters and a NAND circuit NDR. More specifically, NAND circuit NDR which receives control signal PDEN and a signal transmitted from a node NDr to output a NAND logical operation result and the plurality of inverters IVR which invert an output signal of NAND circuit NDR are connected in series. When control signal PDEN is at a "H" level, for example, because NAND circuit NDR functions as an inverter, a number (2n+1) (n: natural number) of inverters are supposed to be connected in series. In addition, an output node of inverter IVR at the last stage is electrically connected to node NDr and a signal transmitted to node NDr is fed back and electrically connected to one of input nodes of NAND circuit NDR. Then, the signal transmitted to node NDr is inverted by an inverter IVR# and transmitted to internal node ND5 of pump circuit PP as a pump driving signal.

Pump driving signal generation circuit PW1, which is a ring oscillator and outputs a clock signal of a fixed cycle as a pump driving signal, allows a size of a transistor forming the inverter to be reduced in order to reduce current consumption.

Figure 6:
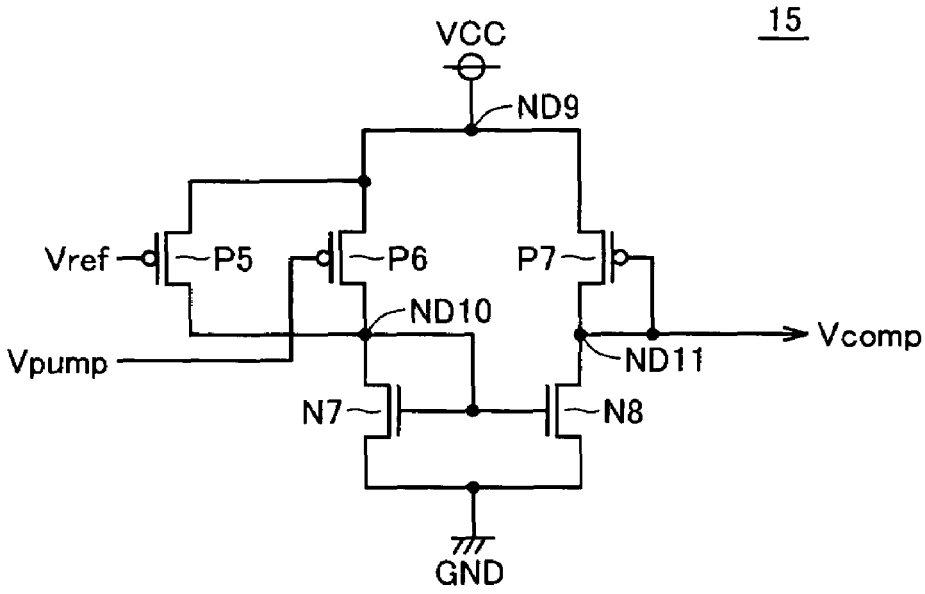
FIG. 6 is a diagram showing a circuit structure of a composing circuit 15 according to the embodiment of the present invention.

With reference to FIG. 6, composing circuit 15 according to the embodiment of the present invention includes transistors P5 to P7 and transistors N7 and N8. Transistors P5 and P6 are assumed to be P channel MOS transistors. Transistors N7 and N8 are assumed to be N channel MOS transistors.

Specific connection relationship will be described.

Transistors P5 and P6 are arranged in parallel to each other between power supply voltage VCC and an internal node ND10 and have their gates designed to receive input of reference voltage Vref and voltage Vpump, respectively. Transistor N7 is arranged between internal node ND10 and fixed voltage GND and has its gate electrically connected to internal node ND10. Transistor P7 is arranged between power supply voltage VCC and an internal node ND11 and has its gate electrically connected to internal node ND11. Transistor N8 is arranged between internal node ND11 and fixed voltage GND so as to form a current mirror circuit with transistor N7 and has its gate electrically connected to internal node ND10.

Next, operation of composing circuit 15 will be described.

When reference voltage Vref and voltage Vpump are applied, out of transistors P5 and P6, a P channel MOS transistor corresponding to a signal of a lower voltage level is strongly turned on. Then, a current path is formed to transistor N7. Then, so as to flow the same passing current as a passing current flowing through transistor N7 by the current mirror circuit formed of transistors N7 and N8, voltage Vcomp, the same voltage as the voltage by which either one of transistors P5 and P6 is turned on is set at output node ND11.

Figure 7:
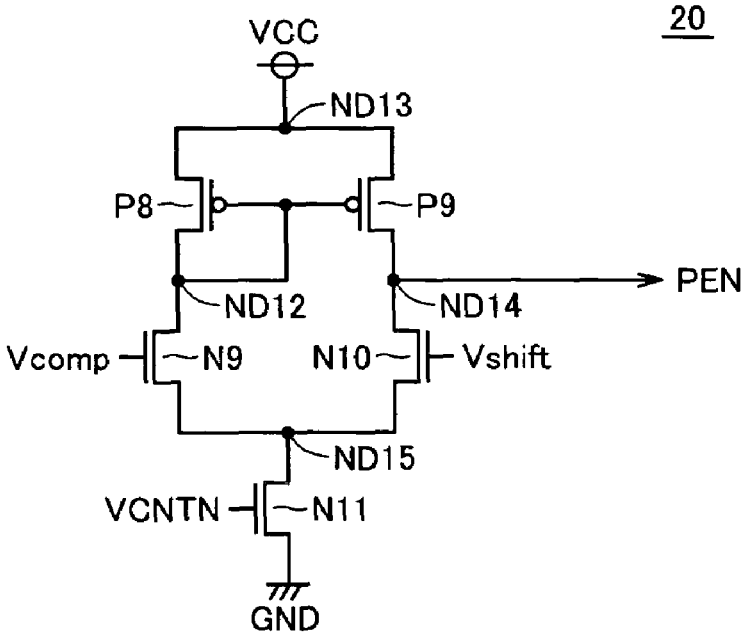
FIG. 7 is a diagram showing a circuit structure of a sensing circuit 20 according to the embodiment of the present invention.

With reference to FIG. 7 sensing circuit 20 according to the embodiment of the present invention includes transistors P8 and P9 and transistors N9 to N11. Transistors P8 and P9 are assumed to be P channel MOS transistors. Transistors N9 to N11 are assumed to be N channel MOS transistors.

Specific connection relationship will be described.

Transistor P8 is arranged between power supply voltage VCC and an internal node ND12 and has its gate electrically connected to internal node ND12. Transistor N9 is arranged between internal node ND12 and an internal node ND15 and has its gate designed to receive input of voltage Vcomp. Transistor P9 is arranged between power supply voltage VCC and an internal node ND14 so as to form a current mirror circuit with transistor P8 and has its gate electrically connected to internal node ND12. Transistor N10 is arranged between internal node ND14 and internal node ND15 and has its gate designed to receive input of voltage Vshift. Transistor N11 is arranged between internal node ND15 and fixed voltage GND and has its gate designed to receive input of a control signal VCNTN. Control signal VCNTN is assumed to be output from control circuit 100 at the time of activating sensing circuit 20.

Sensing circuit 20 compares an input of voltage Vcomp and an input of voltage Vshift to output a signal according to the comparison result as pump activation signal PEN. More specifically, when voltage Vcomp is higher than the input of voltage Vshift, the potential level of internal node ND12 lowers to turn on transistors P8 and P9, so that the potential level of internal node ND14 rises to set pump activation signal PEN at the "H" level.

On the other hand, when voltage Vcomp is not more than the input of voltage Vshift, transistor N10 is turned on to lower the potential level of internal node ND14, so that pump activation signal PEN is accordingly set at a "L" level.

Figure 8:
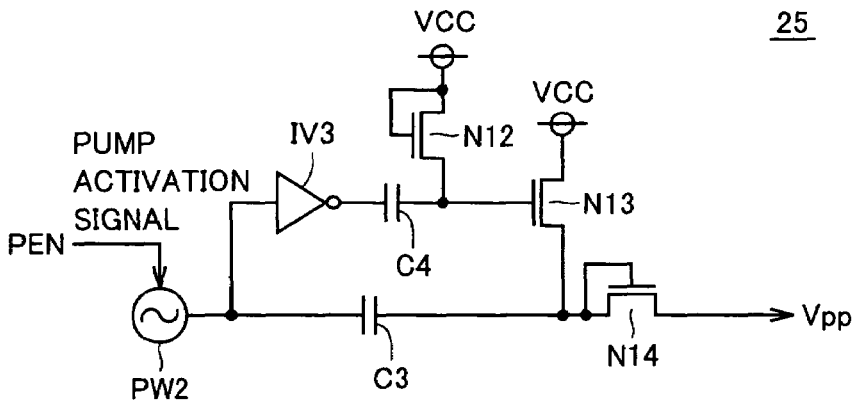
FIG. 8 is a diagram showing a circuit structure of a pump circuit 25 according to the embodiment of the present invention.

With reference to FIG. 8, pump circuit 25 according to the embodiment of the present invention includes a pump driving signal generation circuit PW2, an inverter IV3, capacitors C3 and C4 and transistors N12 to N14. Transistors N12 to N14 are N channel MOS transistors.

Since specific connection relationship is the same as that of a case of pump circuit PP described in FIG. 4, no detailed description thereof will be made.

Pump circuit 25 is activated in response to application of pump activation signal PEN ("H" level). Then, a pump driving signal is transmitted to an internal node from pump driving signal generation circuit PW2 to output boosted voltage Vpp of the 2VCC−Vth level as described above.

Figure 9:
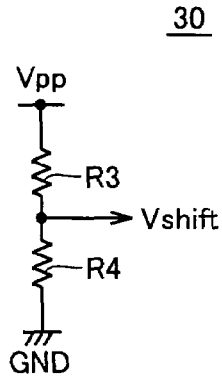
FIG. 9 is a diagram showing a circuit structure of a shifter 30 according to the embodiment of the present invention.

With reference to FIG. 9, shifter 30 according to the embodiment of the present invention includes resistors R3 and R4.

Resistors R3 and R4 are connected in series between power supply voltage Vpp and fixed voltage GND. Voltage Vshift is set based on a predetermined reduction rate according to a resistance division of resistors R3 and R4. Then, the generated voltage Vshift is applied to the gate of transistor N10 of sensing circuit 20 shown in FIG. 2.

It is assumed here that pump circuit 25 and pump circuit PP of dummy pump circuit 10 have the same characteristics. In other words, voltages at the maximum voltage output levels of pump circuit 25 and pump circuit PP are assumed to be the same. Also assume that reduction rates of shifter 30# and shifter 30 are the same. It is designed that in comparison between pump circuit 25 and dummy pump circuit 10, dummy pump circuit 10 has less operation current at the time of pumping operation than that of pump circuit 25. Possible, for example, is setting the operation current of dummy pump circuit 10 to be not more than 1/100 of the operation current of pump circuit 25. More specifically, in order to reduce an operation current, it is, for example, possible to set capacitance values of capacitors C1 and C2 of pump circuit PP of dummy pump circuit 10 to be smaller than capacitance values of capacitors C3 and C4 of pump circuit 25. In addition, in the ring oscillator of pump driving signal generation circuit PW1, the size of the transistor forming the inverter can be made smaller than that of the transistor forming pump driving signal generation circuit PW2. It is also possible to design an oscillation cycle of dummy pump circuit 10 to be shorter than that of pump circuit 25 in order to reduce an operation current.

Figure 10:
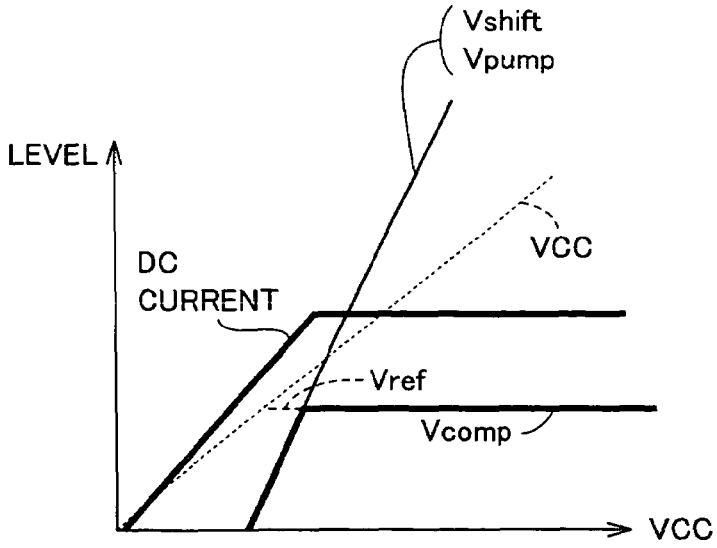
FIG. 10 is a diagram for use in explaining operation of internal power supply voltage generation circuit 1 according to the embodiment of the present invention.

With reference to FIG. 10, operation of internal power supply voltage generation circuit 1 according to the embodiment of the present invention will be described.

Consider a case where an external power supply voltage is a low voltage as here shown, at substantially the same rate of a rise of the voltage level of external power supply voltage VCC, the voltage level of reference voltage Vref of constant voltage generation circuit 5 rises as described above. Then, after power supply voltage VCC starts to rise to a certain level due to pumping capability of pump circuit 25, the voltage level of boosted voltage Vpp starts rising. Shown here are voltage Vshift obtained by stepping down boosted voltage Vpp by shifter 30 and voltage Vpump stepped down in shifter 30# in dummy pump circuit 10. With the present structure, in composing circuit 15, a lower voltage out of reference voltage Vref and voltage Vpump is output as voltage Vcomp. Accordingly, when external power supply voltage VCC is a low voltage, voltage Vcomp output from composing circuit 15 will be set at the same voltage level as that of voltage Vpump of dummy pump circuit 10. Although sensing circuit 20 outputs pump activation signal PEN based on a result of comparison between voltage Vcomp output from composing circuit 15 and voltage Vshift output from shifter 30 when external power supply voltage VCC is a low voltage, because voltage Vcomp and voltage Vshift are of the same voltage level, pump activation signal PEN is set at the "L" level at which operation of pump circuit 25 is stopped.

More specifically, when external power supply voltage VCC is a low voltage, execution of useless pumping operation can be suppressed without supplying a useless pump activation signal PEN ("H" level) to pump circuit 25.

Figure 11:
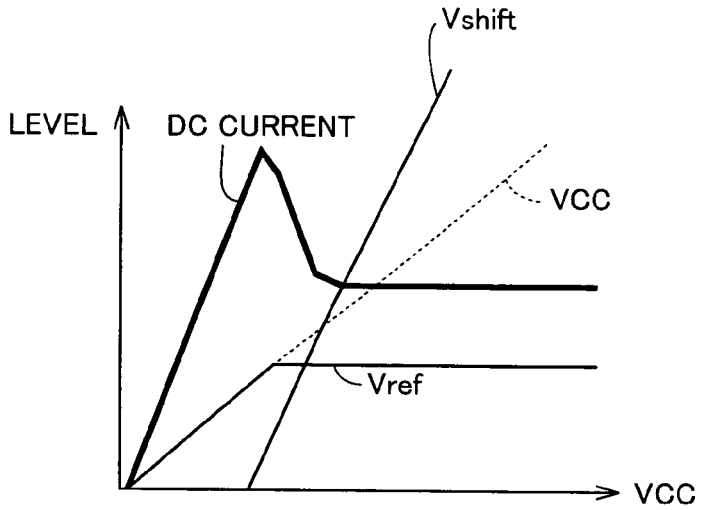
FIG. 11 is a diagram for use in explaining operation of a conventional internal power supply voltage generation circuit.

With reference to FIG. 11, operation of a conventional internal power supply voltage generation circuit will be described.

As shown in FIG. 11, similarly to that described above, at substantially the same rate of the rise of the voltage level of external power supply voltage VCC, the voltage level of reference voltage Vref rises. Then, although after the level of power supply voltage VCC starts rising to a certain level, the voltage level of boosted voltage Vpp starts rising and then voltage Vshift boosted by the shifter rises, because as a boosted voltage level, it rises along with the rise of the voltage level of the external power supply voltage as described above, only a voltage level far lower than the maximum output level of the pump circuit can be output.

Accordingly, when external power supply voltage VCC is a low voltage, reference voltage Vref is higher than voltage Vshift all the time. Although the sensing circuit therefore determines that the boosted voltage level is low to continue outputting "H" level activation signal PEN so as to instruct on pumping operation, because the pump circuit fails to have an output that obtains such a level as inactivating the activation signal of the sensing circuit as described above, constant execution of pumping operation will be instructed to increase current consumption (DC current) when external power supply voltage VCC is a low voltage.

Accordingly, with the structure according to the present embodiment, in a case where external power supply voltage VCC is a low voltage, by setting voltage Vcomp applied to sensing circuit 20 to be output voltage Vpump of dummy pump circuit 10 having the same output characteristics as those of pump circuit 25 in place of reference voltage Vref, generation of pump activation signal PEN is controlled. As a result, internal power supply voltage generation circuit 1 according to the embodiment of the present invention fails to continue outputting activation signal PEN of the "H" level all the time, so that as compared with current consumption shown in FIG. 11, pumping operation of the pump circuit following application of a useless pump activation signal PEN can be suppressed to suppress current consumption, that is, power consumption.

Although internal power supply voltage generation circuit 1 according to the embodiment of the present invention has been described with respect to a structure in which for outputting pump activation signal PEN, sensing circuit 20 compares voltage Vshift obtained by stepping down output voltage Vpp by shifter 30 provided and voltage Vcomp, another structure is possible in which pump activation signal PEN is output based on comparison between output voltage Vpp and voltage Vcomp without provision of shifter 30. More specifically sensing circuit 20 of internal power supply voltage generation circuit 1 according to the first embodiment of the present invention compares voltage Vcomp from composing circuit 15 and the voltage based on the internal power supply voltage to output the comparison result as pump activation signal PEN. Here, the voltage based on the internal power supply voltage is equivalent to output voltage Vpp or voltage Vshift.

In view of this point, since the structure in which output voltage Vpp and voltage Vcomp are compared by sensing circuit 20 needs to raise the voltage level of reference voltage Vref, the structure according to the present invention, aiming at suppressing power consumption of the entire circuit, uses shifter 30 to enable comparison at a low voltage level in sensing circuit 20. The structure according to the present invention further enables reduction in power consumption of composing circuit 15 by lowering the voltage level of reference voltage Vref.

In addition, although the structure according to the present invention has been described with respect to a case where voltage Vpump output by dummy pump circuit 10 and voltage Vshift output by pump circuit 25 and shifter 30 are driven at the same voltage level, since when attaining a higher voltage level than that of reference voltage Vref, voltage Vpump output by dummy pump circuit 10 exerts no effect on voltage Vcomp of composing circuit 15, the maximum output level of voltage Vpump output by dummy pump circuit 10 can be set to be reference voltage Vref. This enables power consumption of dummy pump circuit 10 to be reduced.

Modification Example 1 of the Embodiment

Figure 12:
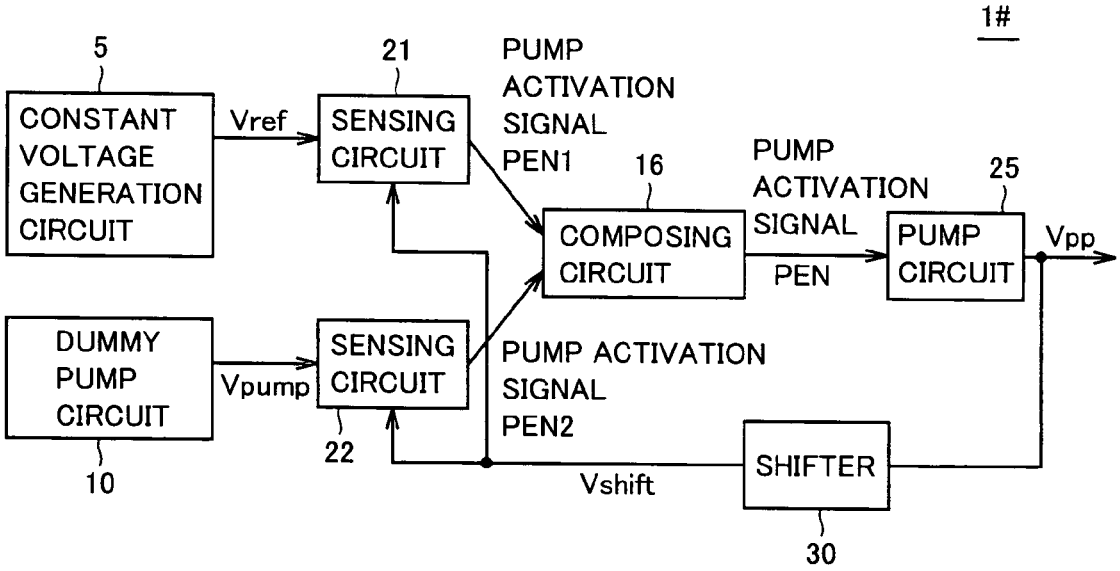
FIG. 12 is a schematic block diagram of an internal power supply voltage generation circuit 1# according to a modification example 1 of the embodiment of the present invention.

With reference to FIG. 12, internal power supply voltage generation circuit 1# according to the modification example 1 of the embodiment of the present invention differs from internal power supply voltage generation circuit 1 described with reference to FIG. 2 in that composing circuit 15 is replaced by a composing circuit 16 and sensing circuit 20 is replaced by sensing circuits 21 and 22 provided corresponding to constant voltage generation circuit 5 and dummy pump circuit 10, respectively. The remaining part is the same and no detailed description thereof will be therefore repeated. Composing circuit 16, sensing circuits 21 and 22 and shifter 30 form an activation signal generation unit which outputs pump activation signal PEN.

Sensing circuit 21 outputs a pump activation signal PEN1 based on the comparison between reference voltage Vref generated from constant voltage generation circuit 5 and voltage Vshift output from shifter 30. Sensing circuit 22 outputs a pump activation signal PEN2 based on the comparison between voltage Vpump output from dummy pump circuit 10 and voltage Vshift output from shifter 30.

Then, composing circuit 16 takes a logical product between pump activation signals PEN1 and PEN2 to generate and output pump activation signal PEN.

Pump circuit 25 is activated upon reception of an input of pump activation signal PEN to generate boosted voltage Vpp by the same pumping operation as that described with reference to FIG. 2.

In internal power supply voltage generation circuit 1# according to the modification example of the present embodiment, sensing circuits 21 and 22 sense a voltage level of voltage Vshift obtained by stepping down the voltage level of output voltage Vpp from pump circuit 25 to output the pump activation signal.

More specifically, when external power supply voltage VCC is a low voltage, sensing circuit 21 outputs pump activation signal PEN1 ("H" level) because the voltage level of reference voltage Vref is higher than that of voltage Vshift. On the other hand, when external power supply voltage VCC is a low voltage, sensing circuit 22 fails to output pump activation signal PEN2 because voltage Vpump and voltage Vshift have the same voltage level as described above. In other words, pump activation signal PEN2 is set at the "L" level. Accordingly, because composing circuit 16 has pump activation signals PEN1 ("H" level) and PEN2 ("L" level), pump activation signal PEN maintains the state of "L" level based on the logical product thereof. It is therefore possible to suppress current consumption, that is, power consumption, similarly to that explained in the description of the embodiment without application of useless pump activation signal PEN to pump circuit 25.

On the other hand, in a case where when external power supply voltage VCC attains an ordinary voltage at which operation of the semiconductor device is ensured, boosted voltage Vpp is consumed to bring the voltage level of voltage Vshift to be equal to or below voltage Vpump and voltage Vref, sensing circuits 21 and 22 both set pump activation signals PEN1 and PEN2 at the "H" level and output the obtained signals to composing circuit 16. Then, composing circuit 16 sets pump activation signal PEN at the "H" level based on a logical product of pump activation signals PEN1 ("H" level) and PEN2 ("H" level). Responsively, predetermined pumping operation is executed in pump circuit 25 so as to again make boosted voltage Vpp attain the maximum output level.

Modification Example 2 of the Embodiment

Figure 13:
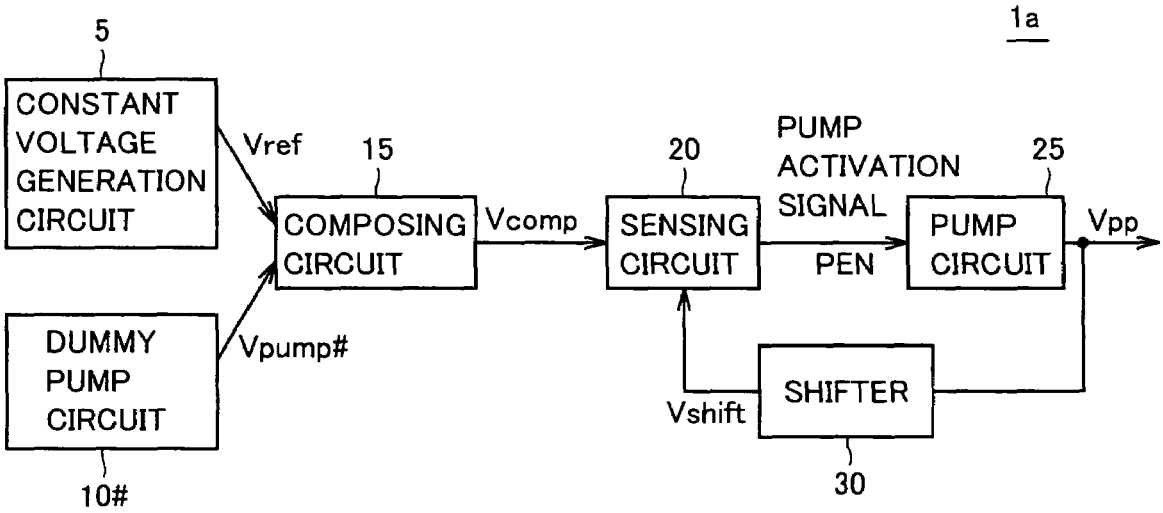
FIG. 13 is a schematic block diagram of an internal power supply voltage generation circuit 1*a* according to a modification example 2 of the embodiment of the present invention.

With reference to FIG. 13, internal power supply voltage generation circuit 1*a* according to the modification example 2 of the embodiment of the present invention differs from internal power supply voltage circuit 1 shown in FIG. 2 in that dummy pump circuit 10 is replaced by a dummy pump circuit 10#. The remaining part is the same and no detailed description thereof will be therefore repeated.

In FIG. 2, the description has been made of a case where dummy pump circuit 10 is formed of pump circuit PP having the maximum output level equivalent to that of pump circuit 25 and shifter 30# having a reduction rate equivalent to that of shifter 30.

More specifically, described is that in a case where dummy pump circuit 10 is formed of pump circuit PP which outputs the maximum output level equivalent to that of pump circuit 25 and shifter 30# having an equivalent reduction rate, when power supply voltage VCC is low, voltage Vpump and voltage Vshift are at substantially the same voltage level, so that pump activation signal PEN is set at the "L" level.

On the other hand, when external power supply voltage VCC or the like fluctuates, there occurs a case where the voltage level of voltage Vpump becomes higher than that of voltage Vshift. In such a case, pump activation signal PEN attains the "H" high level, so that pump circuit 25 might execute pumping operation.

The modification example 2 of the embodiment according to the present invention will be described with respect to a case where when external power supply voltage VCC is a low voltage, control is executed to more reliably prevent pump activation signal PEN from attaining the "H" level.

Dummy pump circuit 10# according to the modification example 2 of the embodiment of the present invention sets a voltage level of an output voltage Vpump# to be a little lower (e.g. lower by 20% to 30%) than voltage Vshift obtained by stepping down the maximum output level of pump circuit 25.

More specifically, although dummy pump circuit 10# has substantially the same structure as that described with reference to FIG. 4, the resistance values of resistors Rd1 and Rd2 which define a reduction rate of shifter 30# are adjusted to set the reduction rate to be a little higher than the reduction rate of shifter 30.

With this arrangement, even when external power supply voltage VCC or the like fluctuates, voltage Vshift becomes higher than voltage Vpump to enable control to prevent pump activation signal PEN from attaining the "H" level, that is, to prevent pump circuit 25 from operating.

While in the embodiment of the present invention, the circuit structure of the internal power supply voltage generation circuit has been described in detail with respect to a booster circuit, executing pumping operation not only in a booster circuit but also in a negative voltage generation circuit based on the same idea enables reduction of current consumption, that is, power consumption.

In the embodiment of the present invention, the internal power supply voltage generation circuit including the pump circuit according to the embodiment of the present invention is applicable to internal circuits of, for example, not only a DRAM (Dynamic Random Access Memory) and a pseudo SRAM (Static Random Access Memory) as a memory and a flash memory but also other memory device, and similarly, the internal power supply voltage generation circuit according to the embodiment of the present invention can be provided in other device than a memory device.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device, comprising:

a first pump circuit for receiving an externally supplied external power supply voltage to generate an internal power supply voltage by pumping operation, an internal circuit for receiving supply of said internal power supply voltage from said first pump circuit, a reference voltage generation circuit for generating a first reference voltage, a second pump circuit which receives supply of said external power supply voltage for generating a second reference voltage by pumping operation, a composing circuit for outputting said second reference voltage when said second reference voltage is lower than said first reference voltage and outputting said first reference voltage when said second reference voltage is higher than said first reference voltage, and a sensing circuit for comparing a voltage obtained by shifting said internal power supply voltage with an output voltage output from said composing circuit to generate an activation signal for controlling pumping operation of said first pump circuit based on the comparison result.

2. A semiconductor device comprising:

a first pump circuit for receiving an externally supplied external power supply voltage to generate an internal power supply voltage by pumping operation, an internal circuit for receiving supply of said internal power supply voltage from said first pump circuit, a reference voltage generation circuit for generating a first reference voltage, a second pump circuit which receives supply of said external power supply voltage for generating a second reference voltage by pumping operation, a composing circuit for outputting said second reference voltage when said second reference voltage is lower than said first reference voltage and outputting said first reference voltage when said second reference voltage is higher than said first reference voltage, and a sensing circuit for comparing an output voltage output from said composing circuit and the voltage obtained by shifting said internal power supply voltage to output a signal instructing on pumping operation of said first pump circuit to said first pump circuit when said output voltage is higher than the voltage based on said internal power supply voltage and output a signal instructing on stop of pumping operation of said first pump circuit to said first pump circuit when said output voltage is equal to or less than the voltage based on said internal power supply voltage.

3. The semiconductor device according to claim 2, further comprising a first shifter for outputting a voltage obtained by stepping down said internal power supply voltage by a first reduction rate as the voltage based on said internal power supply voltage, wherein said second pump circuit further includes a second shifter for stepping down the voltage which is generated by said second pump circuit by said pumping operation by a reduction rate higher than said first reduction rate and outputting the obtained voltage as said second reference voltage.

4. A semiconductor device, comprising:

a first pump circuit for receiving an externally supplied external power supply voltage to generate an internal power supply voltage by pumping operation, an internal circuit for receiving supply of said internal power supply voltage from said first pump circuit, a reference voltage generation circuit for generating a first reference voltage, a second pump circuit which receives supply of said external power supply voltage for generating a second reference voltage by pumping operation, a first sensing circuit for comparing said first reference voltage and the voltage obtained by shifting said internal power supply voltage and when said first reference voltage is higher, outputting a first logical level and when the voltage based on said internal power supply voltage is equal to or less than said first reference voltage, outputting a second logical level, a second sensing circuit for comparing said second reference voltage and the voltage obtained by shifting said internal power supply voltage and when said second reference voltage is higher, outputting a third logical level and when the voltage based on said internal power supply voltage is equal to or less than said second reference voltage, outputting a fourth logical level, and a composing circuit for outputting a signal instructing on operation of the pumping operation of said first pump circuit to said first pump circuit when the output of said first sensing circuit is at said first logical level and the output of said second sensing circuit is at said third logical level.

5. The semiconductor device according to claim 4, further comprising a first shifter for outputting a voltage obtained by stepping down said internal power supply voltage by a first reduction rate as the voltage based on said internal power supply voltage, wherein said second pump circuit further includes a second shifter for stepping down the voltage which is generated by said second pump circuit by said pumping operation by a reduction rate higher than said first reduction rate and outputting the obtained voltage as said second reference voltage.

* * * * *